US005134344A

United States Patent [19]

Vos et al.

[11] Patent Number: 5,134,344

[45] Date of Patent: Jul. 28, 1992

[54] BALLAST CIRCUITS FOR GAS DISCHARGE LAMPS

[75] Inventors: Raymond A. Vos; Francis Moll, both of Enfield, England

[73] Assignee: Thorn Emi plc, London, England

[21] Appl. No.: 508,723

[22] Filed: Apr. 13, 1990

[30] Foreign Application Priority Data

Apr. 14, 1989 [GB] United Kingdom ..... 8908543
Aug. 23, 1989 [GB] United Kingdom ..... 8919164
Apr. 5, 1990 [GB] United Kingdom ..... 9007759

[51] Int. Cl.[5] ..... H05B 41/36

[52] U.S. Cl. ..... 315/239; 315/219; 315/223; 315/224

[58] Field of Search ..... 315/219, 223, 224, 239, 315/DIG. 7, 276, 282

[56] References Cited

U.S. PATENT DOCUMENTS 4,188,660 2/1980 Knoll ..... 315/224 X
4,370,600 1/1983 Zansky ..... 315/239 X
4,392,087 7/1983 Zansky ..... 315/219
4,459,516 7/1984 Zelina et al. ..... 315/219 X
4,511,823 4/1985 Eaton et al. ..... 315/224 X
4,523,131 6/1985 Zansky ..... 315/219 X
4,563,616 1/1986 Stevens ..... 315/219 X
4,719,390 1/1988 Sairanen ..... 315/224 X
4,734,624 3/1988 Nagase et al. ..... 315/DIG. 7 X
4,808,887 2/1989 Fähnrich et al. ..... 315/224 X
4,949,016 8/1990 De Biji et al. ..... 315/224 X
4,961,029 10/1990 Shimizu et al. ..... 315/224 X
4,965,493 10/1990 Van Meurs et al. ..... 315/224

*Primary Examiner*—Eugene R. LaRoche
*Assistant Examiner*—Do Hyum Yoo
*Attorney, Agent, or Firm*—Fleit, Jacobson, Cohn, Price, Holman & Stern

[57] ABSTRACT

A ballast circuit includes a load circuit. A reservoir capacitor is effective to supply charge to the load circuit. A capacitive charge pump circuit is effective to transfer charge from a charge pump capacitive circuit to the load circuit and to the reservoir capacitor. The load circuit includes the primary winding of a transformer. A secondary winding of this transformer is for connection across a discharge lamp. In operation of the ballast circuit, the primary winding of the transformer drives the capacitive charge pump circuit.

19 Claims, 5 Drawing Sheets

BALLAST CIRCUITS FOR GAS DISCHARGE LAMPS

This invention relates to ballast circuits for gas discharge lamps. In particular the invention relates to ballast circuits which draw a low harmonic content input current from an AC supply whilst operating a gas discharge lamp at a higher frequency than that of the supply.

BACKGROUND OF THE INVENTION

One such ballast circuit is shown in U.K. Patent No. 2124042B. The circuits described in this patent are so called capacitive charge pump circuits including a reservoir capacitor connected across the outputs of a full wave rectifier which is in turn connected to an AC supply, the reservoir capacitor being shunted by a series arrangement of two switching devices. A discharge path is provided from the reservoir capacitor, through an output load comprising a series resonant circuit constituted by an inductor and a parallel arrangement of a discharge lamp and a resonating capacitor connected across the cathodes of the lamp, so as to periodically charge a control or charge pump capacitor, this lowering the load voltage and drawing current from the rectified supply. The reservoir capacitor is subsequently recharged by current flowing from the inductor at times defined by the alternate switching of the two switching devices. The circuit is arranged so that the voltage across the reservoir capacitor is always greater than the peak of the mains supply.

Thus in operation of this circuit current and energy can be taken from the mains at all parts of the mains cycle resulting in a low harmonic content waveform being drawn from the supply.

It will be seen that the effectiveness of such a charge pump circuit is dependent on the reservoir capacitor voltage, and the amount of circulating current in the parallel arrangement of the lamp and resonating capacitor. The amount of this circulating current is determined by the value of the resonating capacitor and the operating current of the lamp. As the resonating capacitor is connected across the lamp cathodes, it provides cathode heating current. Thus the value of the resonating capacitor is limited by the maximum current with which the cathode can be driven without long term damage by over heating, this causing a consequential limitation on the amount of circulating current possible, and thus the amount of charge which can be pumped.

It is possible to place an additional capacitor across the lamp thus providing a parallel current path to the cathode circuit in order to increase the circulating current without an accompanying increase in cathode current. Such an arrangement creates problems however in that in normal operation the switching devices will operate at a frequency higher than that of the output resonant circuit constituted by the inductor, lamp, resonating capacitor and additional capacitor. If the lamp is removed, or a cathode breaks during operation of the lamp, the remaining resonant circuit comprising the inductor and additional capacitor will have a higher resonant frequency than that of the original resonant circuit. Consequently the remaining resonant circuit may be instantaneously at or below resonant frequency. This situation may lead to damage to the switching devices due to over current or capacitive switching. Furthermore a large voltage may be left across the lamp terminals thus creating a safety hazard. It is also the case that without the additional capacitor the resonant circuit is broken if the lamp is removed or a cathode is broken; this safety feature is lost if an additional capacitor is used.

SUMMARY OF THE INVENTION

It is an object of the present invention to provide an improved ballast circuit for a discharge lamp.

According to the present invention there is provided a ballast circuit for a discharge lamp, the ballast circuit comprising:

a load circuit including the primary winding of a high frequency transformer, the transformer further including a secondary winding for connection across a discharge lamp;

a reservoir capacitive means effective to supply charge to the load circuit;

and a capacitive charge pump circuit effective to transfer charge from a charge pump capacitive means to the reservoir capacitive means and to the load circuit, in operation, said primary winding being effective to drive the capacitive charge pump circuit.

In a circuit provided in accordance with the present invention the transformer provides voltage isolation of the lamp from the AC supply. Furthermore, the primary inductance, inter-winding inductance and turns ratio of the transformer can be adjusted so as to determine the effective impedance of the load circuit. A ballast circuit provided in accordance with the present invention can be arranged such that, in operation, once the lamp has struck and is of low impedance the voltage across the reservoir capacitive means is instantaneously always at least as great as the voltage produced by the rectified AC supply.

The load circuit may include a series resonant circuit. Advantageously a resonating capacitive means is provided for connection across said secondary winding, whereby, in use, said resonating capacitive means is connected to said secondary winding via the lamp cathodes of said discharge lamp, said resonating capacitive means having a capacitance which is of a value such that, in operation, said resonating capacitive means resonates with the interwinding inductance of the transformer in order to strike and ballast said discharge lamp.

Thus, by use of a circuit in accordance with the invention the primary inductance of the transformer and associated components within the resonant circuit may be adjusted to provide the necessary circulating current so as to obtain the required supply input current waveform, but whilst maintaining suitable heating current through the lamp cathode. The removal of the lamp will reduce the resonant frequency of the output resonant circuit, the transformer providing the additional safety feature of electrical isolation of the lamp from the input mains supply.

Ballast circuits provided in accordance with the invention will now be described, by way of example only, with reference to the accompanying drawings in which:

DESCRIPTION OF THE PREFERRED EMBODIMENTS

Figure 1:
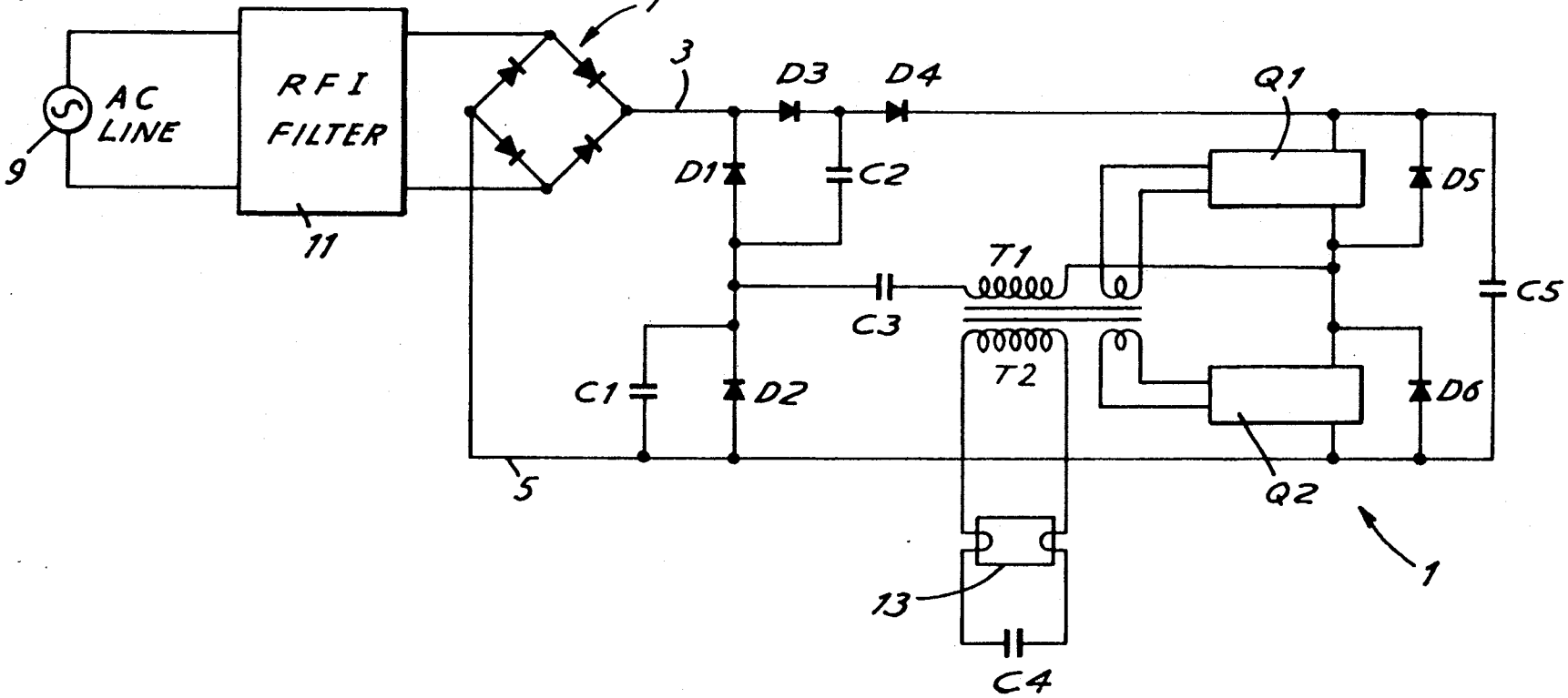
FIG. 1 is a schematic circuit diagram of a ballast circuit provided in accordance with the present invention.

Referring to FIG. 1, a ballast circuit, indicated generally as 1, is connected via respective positive and negative supply rails 3, 5 to the outputs of a full wave diode bridge rectifier circuit 7 which is, in turn connected across an AC supply 9. A radio frequency interference filter 11 is connected across the supply on the AC side of the rectifier circuit 7.

A series arrangement of capacitors C1, C2 are connected across the rails 3, 5, each capacitor C1, C2 being shunted by a respective diode D1, D2. A series resonant circuit comprising a capacitor C3 and the primary winding of a single wire wound ballast transformer T1 is connected to the node between the capacitors C1, C2. A fluorescent lamp 13 is connected across the secondary T2 of the transformer T1, a resonating capacitor C4 being connected across the lamp cathodes.

The series resonant circuit C3, T1 is also connected to the node between two high frequency switching arrangements Q1, Q2 connected across the rails 3, 5, each arrangement Q1, Q2 being shunted by a respective free wheel diode D5, D6. Each switching arrangement Q1, Q2 is powered by a respective further secondary winding coupled to the primary winding of the transformer T1. A reservoir capacitor C5 is connected across the rails 3, 5.

Thus in use of the circuit the capacitor C3 together with the inter-winding inductance of T1 acts as the ballasting impedance of the lamp 13, and resonates with the inductance of the primary winding of the transformer T1. Drive signals are derived from the transformer T1 to switch the switches Q1, Q2 alternately, the radio frequency interference filter 11 being effective to prevent high frequency signals from being transmitted to and from the mains supply 9. The capacitor C2 acts as a charge pump capacitor. Thus when Q2 switches on, C2 charges from the mains. When Q2 subsequently switches off and Q1 switches on, part of the charge of C2 is transferred via T1 to the reservoir capacitor C5. Diodes D3, D4 connected in the rail 3 are effective to allow the charge pump action to transfer charge from the capacitor C2 to the reservoir capacitor C5, the voltage swing at the node between C1 and C2 providing the charge pump swing voltage. Diodes D1 and D2 are effective to clamp the voltages on C1 and C2.

It will be seen that the value of the reservoir capacitor C5 will affect the operation of the circuit. When the value of C5 is large, the voltage across the capacitor C5 will remain substantially constant thus giving a smooth, unmodulated lamp arc current. The charge pump action will however be less efficient as the difference in voltage between the instantaneous mains voltage near zero crossover, and the voltage on the reservoir capacitor C5 will be large. If, however, the value of C5 is smaller, the ripple voltage on C5 will be higher, leading to a 100 Hz modulation of the lamp arc current although the charge pump action will be more efficient. It is found that a compromise between acceptable lamp current modulation and input current waveform shape may be reached.

It will be appreciated that if the lamp 13, and consequently the resonating capacitor C4 is removed from the circuit, or a cathode breaks during operation of the lamp, the effective resonant frequency of the resonant circuit will be reduced. Hence there is no danger of the circuit operating at or below resonance.

Figure 2:
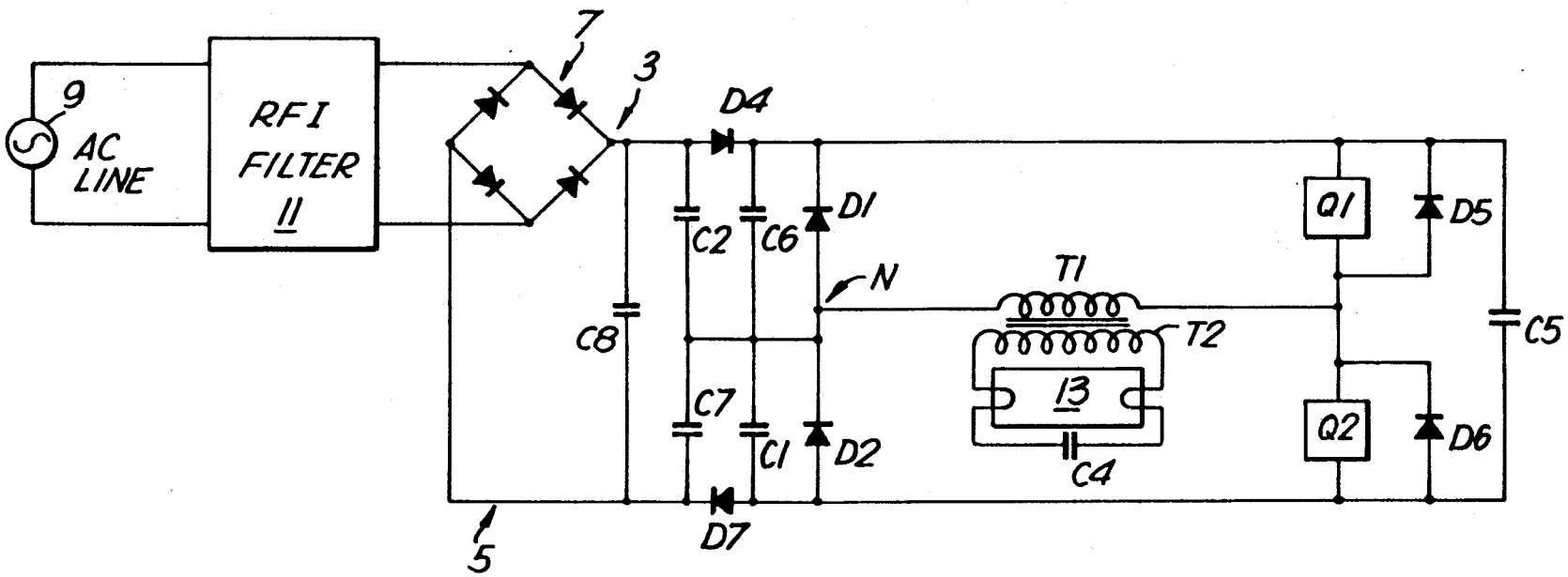
FIGS. 2 and 3 are schematic circuit diagrams of ballast circuits being adaptations of the ballast circuit of FIG. 1.

A second particular circuit will now be described by way of a further example and reference to FIG. 2, this being an adaption of the first example. Accordingly like parts will be designated by like references. A diode, D7, is included in the negative supply rail being effective in conjunction with diode D4 and capacitors C2 and C7 to draw two pulses of current from the rectified supply during each high frequency cycle. C2 and C7 are known as charge pump capacitors whose value is determined by the required power to be drawn from the supply and the frequency of operation of the inverter. Capacitors C1, C6 provide a current path from the capacitive pumping node N, the junction of C1, C2, C6, C7, D1, D2 and T1, to the supply rails of the reservoir capacitor C5 at all times. The capacitors C1, C6 are normally smaller than the charge pump capacitors C2, C7, often a factor in the region 2 to 10; the value depends on the required level of current to flow in the load when the supply voltage is low e.g. near zero crossover as at this time the level of current flow in the charge pump capacitors is low. Diodes D1 and D2 ensure that capacitors C7 and C2 cannot charge to a voltage greater than the instantaneous rectified mains voltage, their connection to either the anode or cathode of diodes D4 and D7 does not substantially affect the operation of the circuit. A series resonant circuit comprising of T1 and C4 is used to strike and ballast one (or more) discharge lamps, C4 being effective to resonate with the interwinding inductance, or leakage reactance of T1. The switches Q1 and Q2 constitute a half bridge inverter and are switched at high frequency, typically in the range 20 kHz to 150 kHz, either by signals generated directly from the resonant circuit or from an alternative source.

Thus by use of this circuit in accordance with the invention the turns ratio, inter-winding inductance and primary inductance of the transformer T1 may be adjusted in order to determine the effective impedance of the ballast circuit between the inverter and charge pumping capacitor network whilst maintaining correct cathode and lamp current and maintaining the feature that when the lamp is removed or a cathode is broken the resonant circuit is also broken. It is advantageous in such cases when the resonant circuit is broken that the primary inductance of the transformer be high, for a 240 Volt 70 Watt circuit operated at 50 kHz this would be above 10 mH, this being effective to ensure that little current flows via the capacitive charge pumping node N and as a consequence that the voltage across the reservoir capacitor C5 does not rise above the peak of the rectified supply voltage.

It is a feature of both the first and second examples that a series resonant circuit is placed between the output of an inverter and a charge pump capacitor network. Such circuits when operating at a frequency near resonance provide a low impedance path irrespective of the lamp impedance and therefore draw significant power from the supply at such times. This gives operational difficulties when the lamp load is of high impedance, for example before the lamp has struck, in that the voltage generated across the reservoir capacitor can become unacceptably high and lead to the self-destruction of the circuit. This difficulty can be overcome by the use of a charge pump disabling network which senses and is activated by the overvoltage condition, however this adds to circuit complexity and cost.

Figure 3:
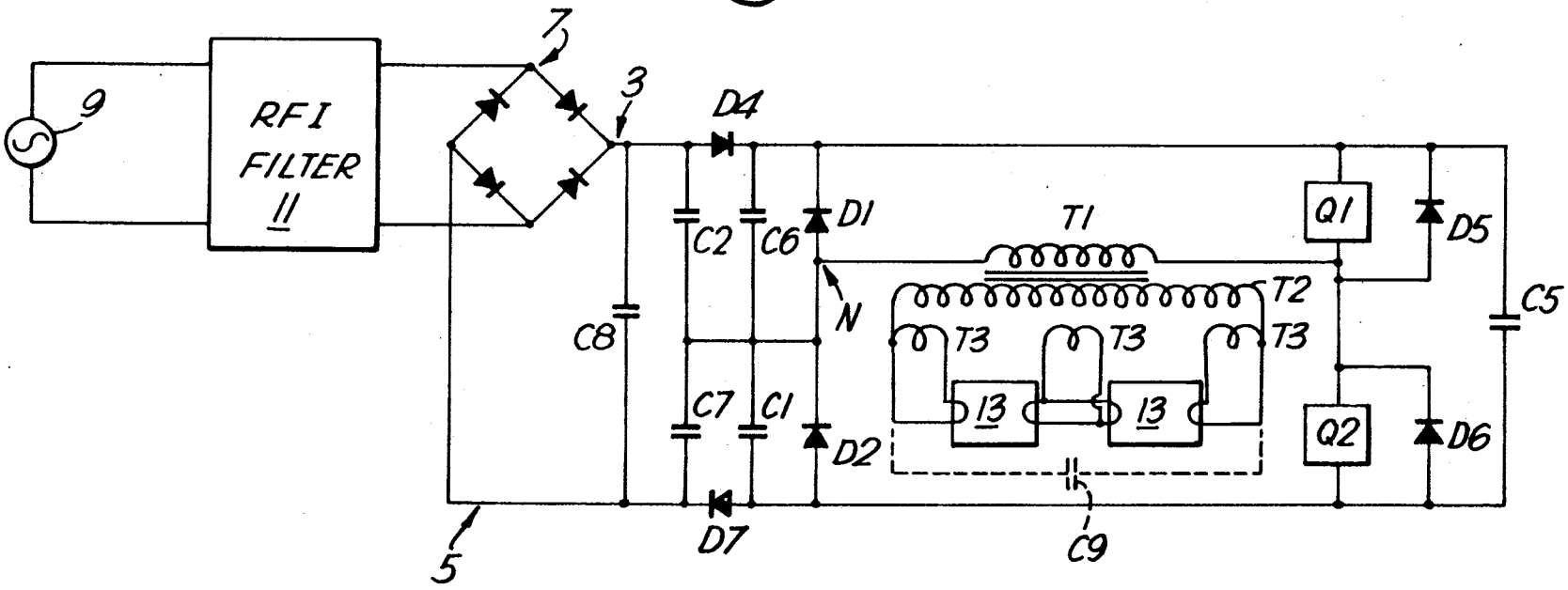

A third particular circuit will now be described with reference to FIG. 3. This circuit is a development of the principle of using a transformer T1 as shown in FIGS. 1 and 2 and accordingly like parts are designated by like references. However there is no resonating capacitor on the secondary T2 of the transformer across the lamp 13. The circuit inherently copes with the fault condition of a deactivated lamp as well as missing lamp or broken cathode conditions without the need of a over-voltage protection circuit as in the fault condition no resonant circuit or significant load are present which would cause effective pumping action and the rail voltage to rise. The ballasting of the lamp 13 is achieved solely by the turns ratio of the transformer together with the transformer inter-winding inductance. The striking of the lamp is achieved by the voltage step-up generated by the transformer together with the application of cathode heating provided by windings T3 coupled closely to the secondary winding of the transformer.

Since there is no resonant circuit and the primary inductance of T1 is high there is no low impedance path between the output of the inverter and the charge pumping node N until the lamp has struck. This event is co-incident with the consumption of power by the lamp, and consequently there is no unavoidable overvoltage condition and no protection circuit is required.

It should be appreciated in such a circuit that a slight resonance effect may occur due to the self-capacitance of the secondary winding of the transformer. It could be advantageous to swamp this self-capacitance using a swamping capacitor (shown in FIG. 3 in dotted line C9) in order to ensure consistent operational behaviour. However the swamping capacitor would be so small as not to interfere with the above described circuit behaviour.

Returning now to the general case in which a transformer ballast is used to drive a capacitive charge pumping node.

It is a further feature of the transformer that voltage isolation is provided between the lamp and the supply, this can be of advantage in terms of reducing the shock hazard from the lamp or by the connection of an earthed starting aid directly to the secondary winding.

Figure 4:
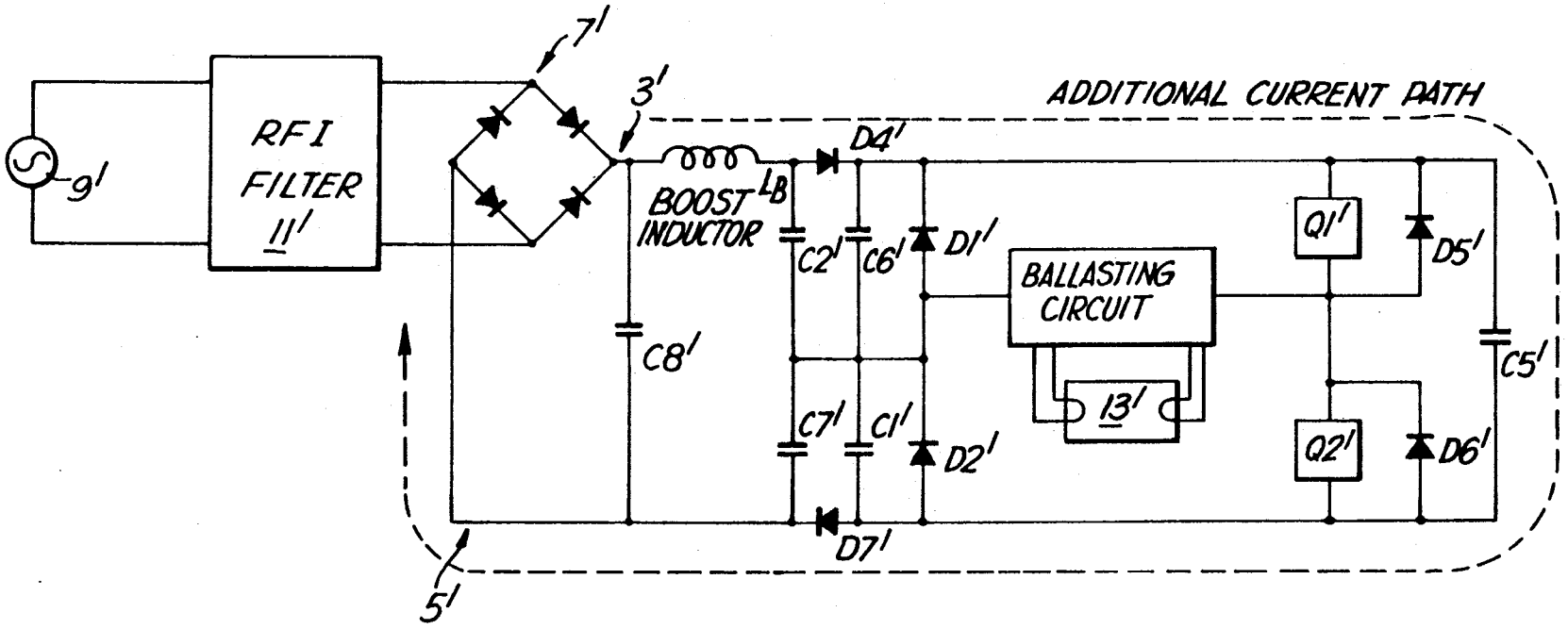
FIG. 4 is a schematic circuit diagram of a ballast circuit including a boost inductor and not provided in accordance with the present invention.

The use of a transformer as a lamp ballasting circuit allows the impedance between the inverter output and capacitive charge pumping node to be lower than is practicable with the conventional non-transformer series resonant circuit. This enables the capacitor charge pump network to be dimensioned and operated in such a manner so as to draw sufficient current from the supply to maintain the voltage across the reservoir capacitor above that of the rectified supply at all times and providing supply current harmonic control without the need to add circuit elements such as an inductor in the output rail of the bridge rectifier. A circuit incorporating an inductor in the output rail is shown in FIG. 4 and is described in more detail later.

There are two possible modes of operation of the general capacitor charge pump and transformer circuit provided in accordance with the present invention.

Mode 1

During normal operation with the lamp(s) in circuit the impedance of the transformer circuit is low enough to allow the charge pump capacitors to charge substantially to the instantaneous rectified mains voltage and to substantially discharge during each high frequency cycle throughout each supply cycle. If the switching frequency is constant throughout the supply frequency cycle a unity power factor waveform (one with no or very low harmonic content) will be drawn. In this mode of operation an increase in switching frequency will result in an increase of input power and hence an increase in the voltage across the reservoir capacitor. The energy drawn from the mains in this mode of operation is given by the following formula:

$$P=fC(Vm)^2$$

where

P=input power (Watts)

f=operating frequency (Hz)

C=value of charge pump capacitors C2+C7

Vm=rms voltage of supply voltage

Accordingly, for a required circuit arrangement, the capacitances of the charge pump capacitors C2, C7 can be determined from this formula.

Mode 2

During normal operation with the lamp(s) in circuit the impedance of the transformer circuit is low enough to allow the charge pump capacitors to charge substantially to the instantaneous rectified mains voltage and to substantially discharge during each high frequency cycle. However the impedance of the transformer circuit is sufficiently high enough that this charging and discharging occurs only during a portion of the supply cycle when the rectified supply voltage is below some value, less than its peak. In this mode of operation the current drawn from the supply will contain some harmonic content but low in level and can be below levels set out in international standards. This mode of operation is such that a decrease in frequency will result in the charge pump capacitors being charged to the instantaneous rectified supply voltage and discharged for a larger part of the supply frequency cycle, the input power being increased and the harmonic content of the supply current waveform being decreased together with the characteristic increase of voltage across the reservoir capacitor. For a given load power and inverter operating frequency both the capacitance of the charge pump capacitors and the impedance of the transformer circuit feeding back to the capacitive charge pump node will be higher than in a circuit operated in mode 1.

Using a self oscillating inverter circuit it is generally difficult to achieve satisfactory operation of the circuit in either of the modes described above. In a self-oscillating circuit the switching frequency of the inverter is controlled by the current flowing in the resonant circuit; it is not generally possible to control the voltage across the reservoir capacitor by this means; it is also generally difficult to arrange that switching takes place at optimum times throughout the supply cycle. Following the switching of the inverter the charge pump capacitors C2, C7 will charge from the supply until clamped by diodes D1 or D2. If the inverter does not switch at this point power will continue to be consumed by the lamp load but no further power will be drawn from the supply in that half high frequency cycle. Accordingly, in order to optimise the drawing of power from the mains in accordance with operational modes 1 and 2 described it is necessary to switch before, at or shortly after the times when diodes D1 or D2 clamp the voltage across the charge pump capacitors C2, C7; this is not necessarily co-incidental with the natural switching point of a self oscillating circuit. Generally both of these difficulties (control of capacitive smoothing means voltage and switching point) can be addressed by the inclusion of a boost inductor $L_B$ added in series to the output of the bridge rectifier. FIG. 4 shows a circuit which includes a boost inductor $L_B$. The circuit includes components X' similar to those components X in the circuits of FIGS. 1 to 3 and these are referenced as indicated. FIG. 4 also shows the resulting additional current path. The inductor $L_B$ acts principally to conduct charge in a direct path from the rectified supply to the reservoir capacitor C5' and this compensates for the inefficient capacitive charge pumping. Limited voltage regulation is achieved by the mechanism whereby the boost inductor $L_B$ is discharged according to the amount by which the voltage across the reservoir capacitor C5' exceeds that of the rectified supply voltage.

These problems can be overcome by the use of a control circuit and driven inverter together with the transformer circuit as described. It is possible to avoid the use of a boost inductor and if a non-resonant ballast is also used then a highly cost effective ballast can be produced. The cost of control circuits are likely to fall with the advancement of semiconductor technology whereas the price of inductive components and capacitors are unlikely to fall in the future.

Figure 5:
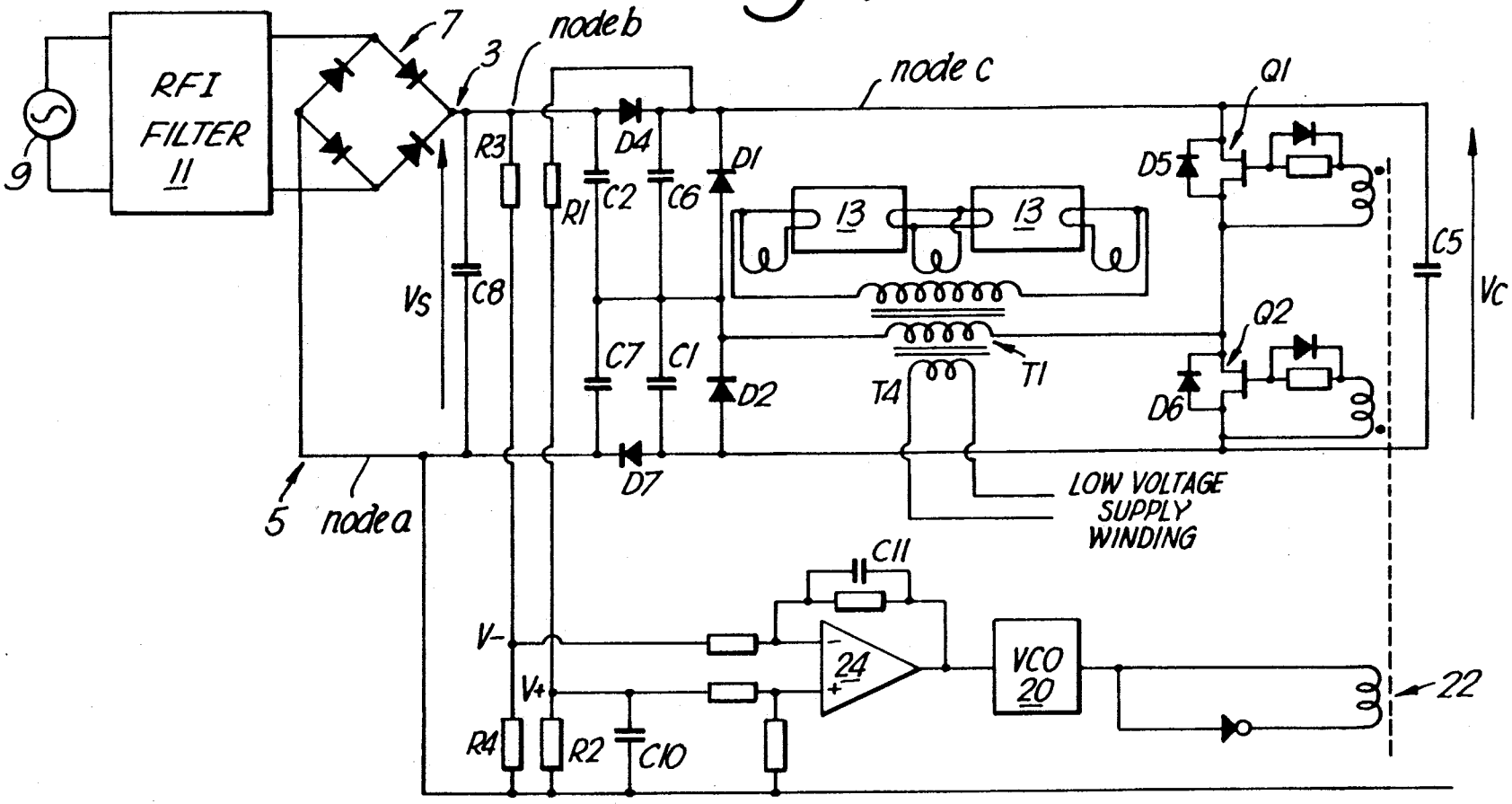
FIG. 5 is a schematic circuit diagram of another ballast circuit including a control circuit and provided in accordance with the present invention.

A fourth particular circuit which is an example of such a ballast is shown in FIG. 5. Again, like parts to those of FIGS. 1 to 3 are designated by like references. In this example the driven inverter is created using MOSFETS Q1, Q2 which are driven from a voltage controlled oscillator 20 via a voltage transformer 22. Whilst it will be appreciated that there are several ways in which such a circuit might be controlled, for example to regulate lamp power or lamp current, it is particularly beneficial to regulate the voltage across the reservoir capacitor C5 since this can be used to ensure that the said voltage is maintained above the rectified supply during all normal operating modes without rising to voltages which might over-stress components.

It is possible to dimension and operate such circuits according to mode 1 or mode 2. This particular example operates in mode 2 and is controlled by regulating the voltage across the reservoir capacitor C5 to be a multiple of the rectified supply voltage; whilst being simple to implement this control achieves good power regulation against variation in supply voltage. The control loop is implemented by sensing as depicted in FIG. 5. Using node 'a' as a 0 Volt reference the voltage at node 'b' shall be denoted Vs, the voltage at node 'c' shall be denoted Vcs, the voltage across the reservoir capacitor being denoted Vc. From observation it will be appreciated that Vs represents the rectified supply voltage and that Vcs represents a voltage which switches between the rectified supply voltage and the voltage across the reservoir capacitor at the high frequency switching speed. Provided the high frequency has a symmetric duty cycle the time averaged equivalent voltage of Vcs is given by $$Vcs=(Vc+Vs)/2$$

The control circuit uses resistor chains R1, R2; R3, R4 to generate respectively two signals as follows:

$$V+=k1\ (Vc+Vs)$$

$$V-=k2\ Vs$$

where k1 and k2 are constants determined by the resistor chains.

A differential amplifier 24 generates an output signal, Vo, which is of the form $$Vo=K3\ (Vc-k4\ Vs)$$

where k3 and K4 are constants derived from k1, k2 and the gain of the amplifier, ie Vo is proportional to the error of the reservoir capacitor voltage being a fixed multiple (k4) of the rectified supply voltage.

The voltage to frequency converter 20 is driven by Vo and has a response such that the output frequency increases with Vo. Time constants which are effective to stabilise the control loop and to time average the signals V+, V− and Vo are included by capacitive means C10, C11 in the amplifier stage.

FIG. 5 also shows that a low voltage supply for the control circuit can be generated from a winding T4 coupled closely to the primary of the transformer T1. It will be appreciated that a low voltage regulator and start-up circuit and features such as implementing a different control mode during the lamp striking phase could be added by a person knowledgeable in the art. It is clear that the reservoir capacitor voltage can be readily derived from the Vcs signal.

It should be noted that, for the purposes of minimising the level of high frequency interference which is conducted onto the supply, it is advantageous to arrange that the capacitive charge pumping network be fully symmetrical, in this case that C2 should be the same value as C7 and that C1 should be the same value as C6; this can simplify and reduce the cost of the necessary Radio Frequency Interference filter 11. To reduce further the size of the RF1 filter before the bridge rectifier a small capacitor, shown in FIGS. 2 and C8, (typically 100 nF) to act as a hf bypass can be connected across the output of the bridge rectifier 7.

We claim:

1. A ballast circuit for drawing a low harmonic content input current from an AC supply for a discharge lamp, including a load circuit, a reservoir capacitive means effective to supply charge to the load circuit, a capacitive charge pump circuit effective to transfer charge from a charge pump capacitive means to the reservoir capacitive means and to the load circuit, wherein the improvement lies in that said load circuit includes the primary winding of a high frequency transformer, the transformer further including a secondary winding for connection across a lamp circuit including a discharge lamp, whereby in operation said primary winding is effective to drive the capacitive charge pump circuit thereby optimizing the charge that may be drawn from the supply.

2. A ballast circuit according to claim 1 wherein the load circuit includes a series resonant circuit.

3. A ballast circuit according to claim 2 comprising a resonating capacitive means for connection across said secondary winding, whereby, in use, said resonating capacitive means is connected to said secondary winding via the lamp cathodes of said discharge lamp, said resonating capacitive means having a capacitance which is of a value such that, in operation, said resonating capacitive means resonates with the interwinding inductance of the transformer in order to strike and ballast said discharge lamp.

4. A ballast circuit according to claim 1 comprising:

means for deriving a rectified AC voltage from an AC supply, said deriving means having at least one output a positive line and a negative line connected to respective outputs of said means for deriving a rectified AC voltage;

a first switching device and a second switching device, said first and second switching devices being alternately conductive at a high switching frequency in operation;

wherein the charge pump circuit comprises at least one said charge pump capacitive means connected to at least one first capacitive means at a capacitive charge pumping node, said at least one charge pump capacitive means being connected to said means for deriving a rectified AC voltage, and said primary winding is connected between said capacitive charge pumping node and the midpoint of said first and said second switching devices.

5. A ballast circuit according to claim 4 comprising a line current rectifying device in each of said positive line and said negative line for allowing forward conduction of current from said means for deriving a rectified AC voltage to said reservoir capacitive means;

a first current rectifying device for allowing current to flow from said capacitive charge pumping node to the positive terminal of said reservoir capacitive means and a second current rectifying device for allowing current to flow from the negative terminal of said reservoir capacitive means to said capacitive charge pumping node;

said at least one first capacitive means being connected to a terminal of said reservoir capacitive means; and in operation, said midpoint of said first and said second switching devices being alternately connected to each terminal of said reservoir capacitive means.

6. A ballast circuit according to claim 4 wherein the primary inductance of the transformer is of at least a value so that, in operation, the current flow via the capacitive charge pumping node is insufficient to maintain the voltage across the reservoir capacitive means above that of the peaks of the rectified supply voltage when the impedance of said lamp circuit across said secondary winding exceeds a critical value determined by an operational state of said circuit across said secondary winding.

7. A ballast circuit according to claim 4 wherein said capacitive charge pumping node is connected to said respective outputs of said means for deriving a rectified AC voltage via said charge pump capacitive means of substantially equal value.

8. A ballast circuit according to claim 4 wherein the impedance of the transformer circuit between the capacitive charge pumping node and the midpoint of said first and said second switching devices is no greater than a value such that in operation each said charge pump capacitive means is charged substantially to the instantaneous rectified supply voltage and substantially discharged during each high switching frequency cycle throughout each supply cycle whereby an increase in said high switching frequency results in an increased power being drawn from the supply and an increase in the voltage across said reservoir capacitive means.

9. A ballast circuit according to claim 4 wherein the impedance of the transformer circuit between the capacitive charge pumping node and the midpoint of said first and said second switching devices is at least a value such that in operation each said charge pump capacitive means is charged substantially to the instantaneous rectified supply voltage and substantially discharged during each high switching frequency cycle only during the portion of the supply cycle when the rectified supply voltage is below a defined value less than its peak value whereby a decrease in said high switching frequency results in an increased power being drawn from the supply and an increase in the voltage across said reservoir capacitive means.

10. A ballast circuit according to claim 4 further comprising a control circuit for controlling said high switching frequency whereby other circuit parameters may be varied.

11. A ballast circuit according to claim 10 wherein the control circuit is used to regulate the voltage across the reservoir capacitive means by varying said high switching frequency.

12. A ballast circuit according to claim 11 wherein the voltage across the reservoir capacitive means is regulated to be a multiple of the rectified AC voltage.

13. A ballast circuit according to claim 12 wherein the control circuit includes a first sense input for sensing a proportion of the output voltage of said means for deriving a rectified AC voltage and a second sense input for sensing a proportion of the voltage across said first and said second switching devices, said first sense input comprising a first resistor chain connected directly between said respective outputs of said means for deriving a rectified AC voltage and said second sense input comprising a second resistor chain connected between a terminal of said reservoir capacitive means and one of said respective outputs of said means for deriving a rectified AC voltage.

14. A ballast circuit according to claim 1 further comprising at least one winding for providing cathode heating current to said lamp, said at least one winding being closely coupled to said secondary winding.

15. A ballast circuit according to claim 1 wherein the transformer further comprises another winding for generating a low voltage supply.

16. A ballast circuit according to claim 4 wherein a filter capacitance is connected directly across said at least one output of said means for deriving a rectified AC voltage.

17. A ballast circuit according to claim 1 wherein said transformer includes more than one secondary winding each for connection across at least one discharge lamp.

18. A ballast circuit according to claim 1 capable of switching at a high frequency switching speed and further comprising a swamping capacitive means connected directly across said secondary winding, said swamping capacitive means having a capacitance which is greater than the self-capacitance of said secondary winding and sufficiently low that, in use, with the circuit switching at a high frequency switching speed, no significant resonance is produced with the inter-winding inductance of the transformer.

19. A ballast circuit for drawing a low harmonic content input current from an AC supply for a discharge lamp, including a non-resonant load circuit, a reservoir capacitive means effective to supply charge to the load circuit, a capacitive charge pump circuit effective to transfer charge from a charge pump capacitive means to the reservoir capacitive means and to the load circuit, wherein the improvement lies in that said load circuit includes the primary winding of a high frequency transformer, the transformer further including a secondary winding for connection across a lamp circuit including a discharge lamp, whereby in operation said primary winding is effective to drive the capacitive charge pump circuit thereby optimizing the charge that may be drawn from the supply.

* * * * *